US010494888B2

(12) United States Patent
Wesson et al.

(10) Patent No.: US 10,494,888 B2
(45) Date of Patent: Dec. 3, 2019

(54) WELLHEAD CONNECTION ASSEMBLY

(71) Applicant: Access Oilfield Services LP, Norman, OK (US)

(72) Inventors: Shea Keller Wesson, Norman, OK (US); Harold Robinson Wesson, Norman, OK (US); Michael Scott, Blanchard, OK (US)

( * ) Notice: Subject to any disclaimer, the term of this patent is extended or adjusted under 35 U.S.C. 154(b) by 128 days.

(21) Appl. No.: 15/609,952

(22) Filed: May 31, 2017

(65) Prior Publication Data

US 2017/0342793 A1 Nov. 30, 2017

Related U.S. Application Data

(60) Provisional application No. 62/343,413, filed on May 31, 2016.

(51) Int. Cl.
*E21B 33/04* (2006.01)

(52) U.S. Cl.
CPC ..... *E21B 33/04* (2013.01)

(58) Field of Classification Search
CPC ..... E21B 33/04
See application file for complete search history.

(56) References Cited

U.S. PATENT DOCUMENTS

| | | | |
|---|---|---|---|
| 3,341,232 | A | 9/1967 | Deakins |
| 4,163,571 | A | 8/1979 | Nash |
| 4,417,755 | A | 11/1983 | Gittleman |
| 4,460,201 | A | 7/1984 | McGugan |
| 4,547,003 | A | 10/1985 | McGugan |
| 5,004,275 | A | 4/1991 | Miller |
| 5,277,460 | A | 1/1994 | Grainge |
| 5,282,655 | A | 2/1994 | Marietta |
| 5,309,991 | A | 5/1994 | Watkins |
| 8,616,588 | B2 | 12/2013 | Weinhold |
| 2005/0145391 | A1 | 7/2005 | Lequang et al. |
| 2007/0114039 | A1 | 5/2007 | Hobdy et al. |
| 2008/0185156 | A1 | 8/2008 | Rodgers et al. |
| 2010/0224373 | A1 | 9/2010 | Williams et al. |
| 2011/0266006 | A1 | 11/2011 | Lacheny et al. |
| 2015/0204154 | A1 | 7/2015 | McClinton et al. |

*Primary Examiner* — Kristyn A Hall

(74) *Attorney, Agent, or Firm* — Dunlap Codding, P.C.

(57) ABSTRACT

A wellhead connection assembly is provided with a landing mandrel, a casing head, and a clamp ring. The landing mandrel and the casing head have mirrored annular grooves formed at an upper end and a lower end, respectively. The annular grooves form an upper flange on the landing mandrel and a lower flange on the casing head. The clamp ring is provided with at least two ring segments; each having a groove formed on an inner surface that matches the profile of the upper flange and the lower flange. The first end of one of the ring segments is connected to the second end of another one of the ring segments in a way that the clamp ring is operable between a non-tightened condition wherein the casing head is rotatable relative to the landing mandrel and a tightened condition to fix the casing head to the landing mandrel.

12 Claims, 10 Drawing Sheets

WELLHEAD CONNECTION ASSEMBLY

CROSS-REFERENCE TO RELATED APPLICATIONS

This application claims priority to U.S. Provisional Application Ser. No. 62/343,413, filed on May 31, 2016, the entire contents of which being hereby expressly incorporated herein by reference.

BACKGROUND

A wellhead assembly includes several components of drilling equipment that must be sealingly attached to a terminal end of a casing string extending into a drilled well. Due to the vertical height of the fully assembled wellhead, the casing string is typically terminated several feet below the surface within a constructed cellar. Generally, this connection has been achieved by welding the wellhead to a landing mandrel attached to the terminal end of the casing within the cellar. This welding task is difficult due to the tight quarters of the cellar, the size of the wellhead assembly, and the time required welding the entire circumference of the landing mandrel. In addition, the wellhead becomes fixed after welded so that the rotational position of the wellhead cannot be adjusted to facilitate access to valves and pipes of the wellhead assembly.

Therefore, a need exists for a quick wellhead connection assembly and method for connecting a wellhead assembly to the landing mandrel of a casing string. It is to such a wellhead connection assembly and method that the inventive concepts disclosed herein are directed.

BRIEF DESCRIPTION OF THE DRAWINGS

The accompanying drawings, which are incorporated in and constitute a part of this specification, illustrate one or more implementations described herein and, together with the description, explain these implementations. The drawings are not intended to be drawn to scale, and certain features and certain views of the figures may be shown exaggerated, to scale or in schematic in the interest of clarity and conciseness. Not every component may be labeled in every drawing. Like reference numerals in the figures may represent and refer to the same or similar element or function. In the drawings.

DETAILED DESCRIPTION OF EXEMPLARY EMBODIMENTS

Figure 1:
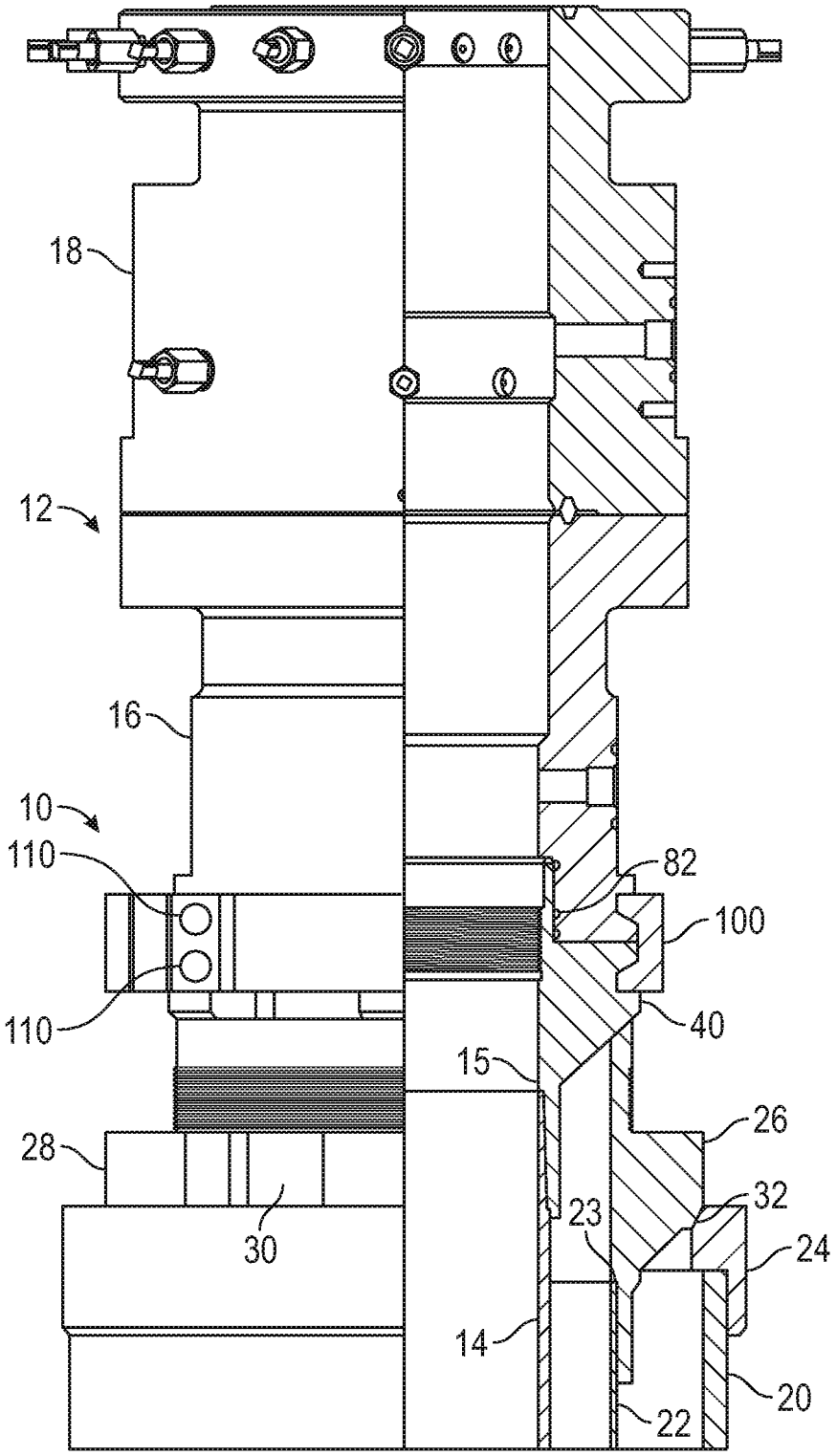
FIG. 1 is a cutaway, elevational view of a wellhead connection assembly constructed in accordance with the inventive concepts disclosed herein shown connecting a wellhead to a casing string.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments, or of being practiced or carried out in various ways. Also, it is to be understood that the phraseology and terminology employed herein is for the purpose of description and should not be regarded as limiting the inventive concepts disclosed and claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having," and any variations thereof, are intended to cover a non-exclusive inclusion. For example, a process, method, article, or apparatus that comprises a list of elements is not necessarily limited to only those elements, and may include other elements not expressly listed or inherently present therein.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B is true (or present).

In addition, use of the "a" or "an" are employed to describe elements and components of the embodiments disclosed herein. This is done merely for convenience and to give a general sense of the inventive concepts. This description should be read to include one or at least one and the singular also includes the plural unless it is obvious that it is meant otherwise.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Figure 2:
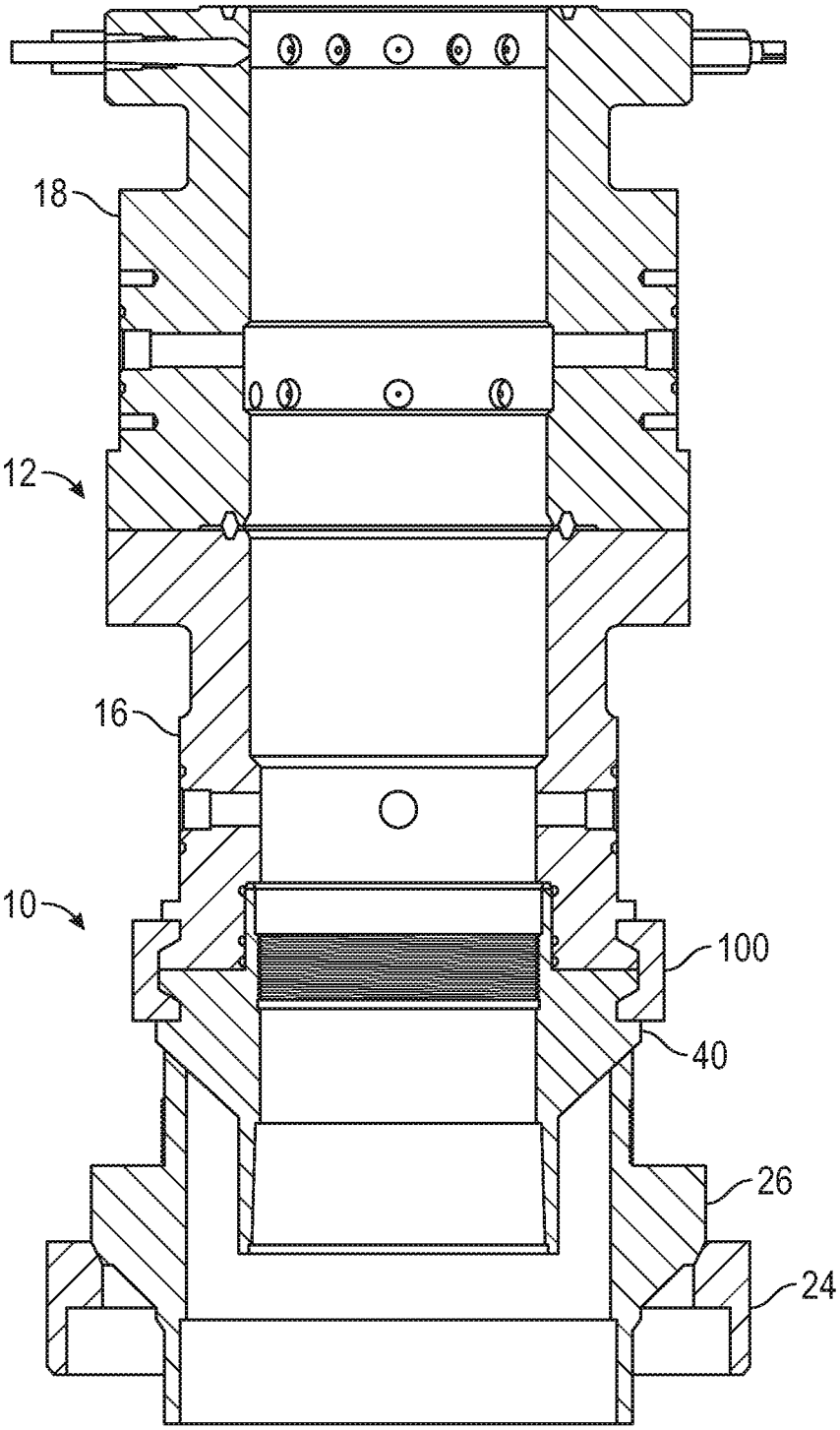
FIG. 2 is a sectional view of the wellhead connection assembly of FIG. 1 with the casing string removed for clarity.
Figure 3A:
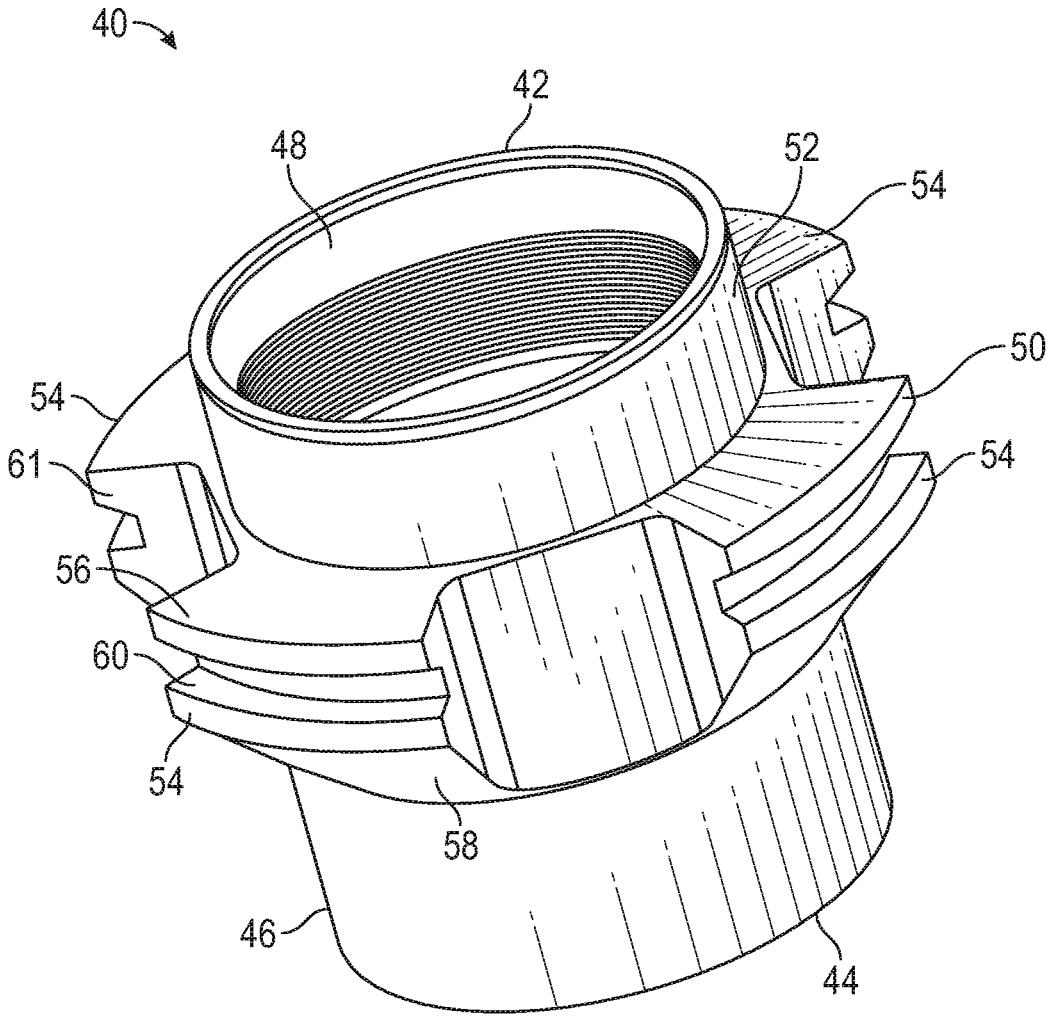
FIG. 3A is a perspective view of a landing mandrel constructed in accordance with the inventive concepts disclosed herein.
Figure 3B:
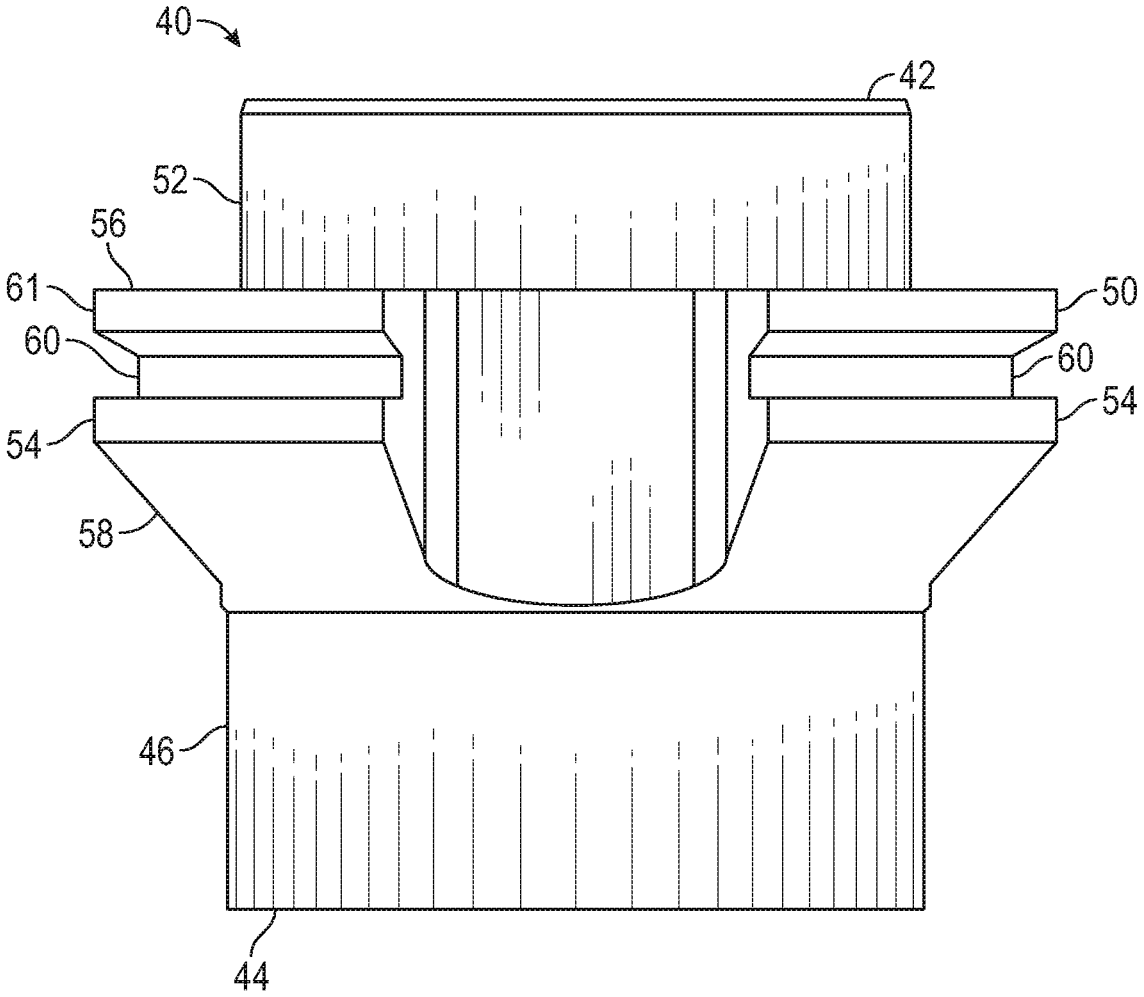
FIG. 3B is an elevational view of the landing mandrel of FIG. 3A.
Figure 3C:
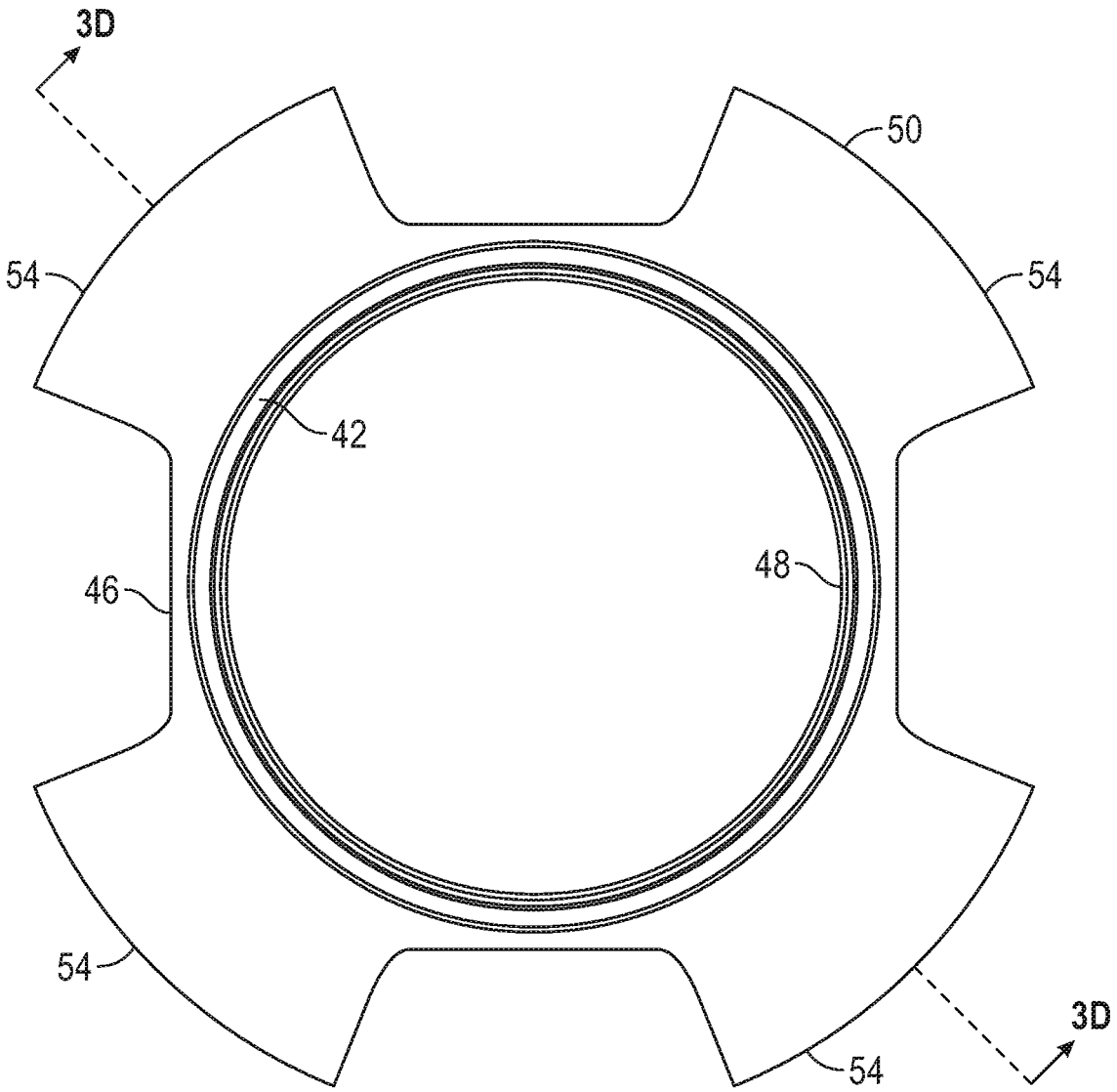
FIG. 3C is a top plan view of the landing mandrel of FIG. 3A.
Figure 3D:
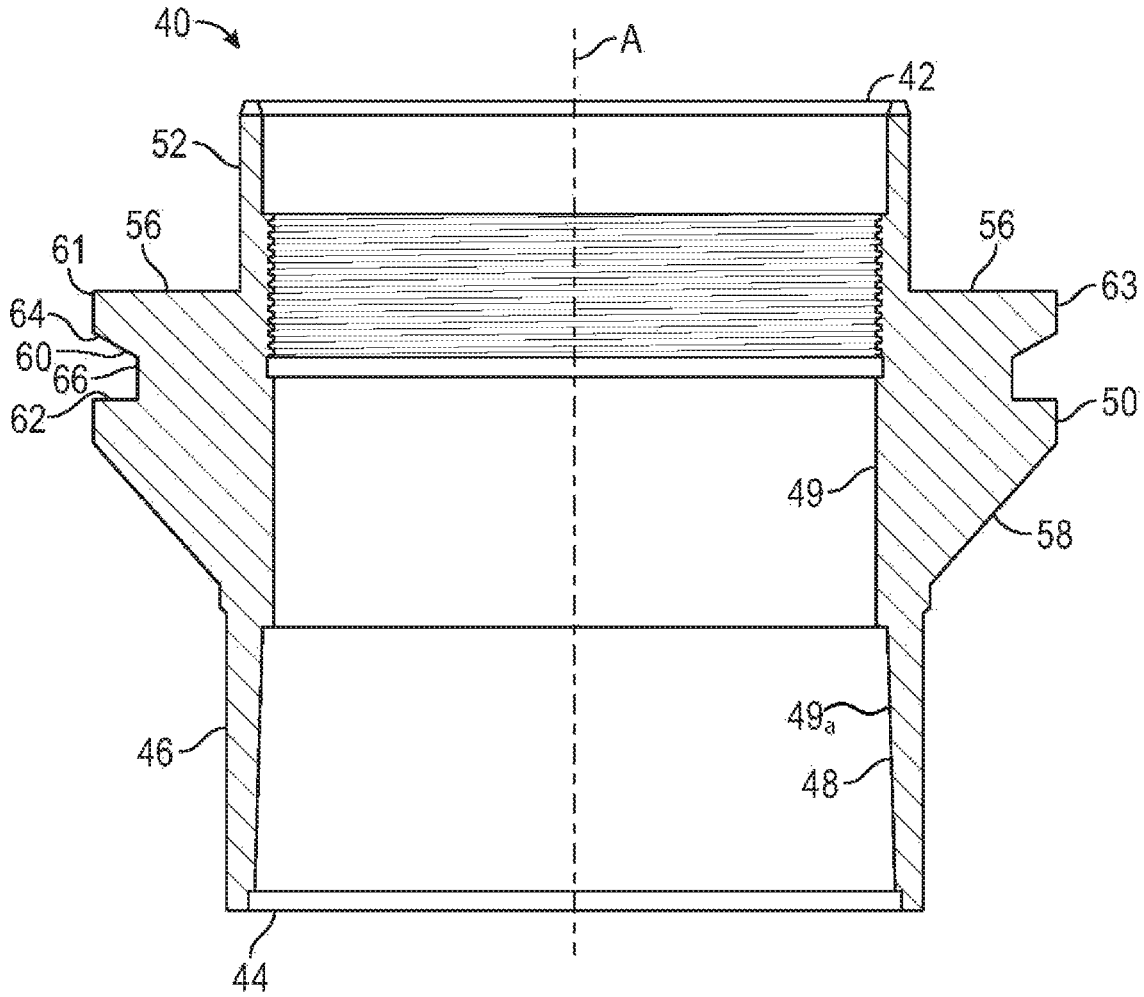
FIG. 3D is a sectional view of the landing mandrel taken along line 3D-3D of FIG. 3C.

Referring now to the drawings, and in particular FIGS. 1 and 2, a wellhead connection assembly 10 constructed in accordance with the inventive concepts disclosed herein is shown connecting a wellhead assembly 12 to a casing string 14. The wellhead assembly 12 is illustrated as including a casing head 16 and a casing spool 18. The casing string 14 is shown to be an intermediate casing string. FIG. 1 also illustrates a conductor pipe 20 and a surface casing string 22. The wellhead connection assembly 10 provides a quick connect for the wellhead assembly 12 to a casing string. While the wellhead assembly 12 is described and illustrated as being connected to an intermediate casing string, it should be appreciated that the wellhead connection assembly 10 can be employed to connect a wellhead assembly to any casing string (e.g., surface casing string). The wellhead connection assembly 10 includes a landing mandrel 40, the casing head 16, and a clamp ring 100.

Preparing an oil or gas well to access a hydrocarbon formation generally requires the steps of: drilling a hole, installing a conductor pipe in the hole, installing a surface casing and cementing the surface casing, attaching a wellhead assembly to the surface casing, and completing the drilling process to the required depth of the hydrocarbon formation. One of ordinary skill in the art would understand that the general procedure for drilling and preparing a well can be accomplished in any number of ways. For example, in some embodiments, a second or intermediate casing string can be installed in the surface casing and cemented to the surface casing. The wellhead assembly is then attached to the intermediate casing.

Regardless of how the well is prepared, all wells require the wellhead assembly to be sealingly connected to a casing string that extends into the ground. As discussed above, this sealing connection between the wellhead assembly and the casing string is accomplished by means of an extensive circumferential weld between the bottom of the wellhead assembly and a terminal end or connector end of the casing string. In some cases, one or more welds are required to ensure a sealed connection. One of ordinary skill in the art will appreciate that the task of welding the wellhead assembly to the casing string is labor intensive and therefore costly. In addition, the wellhead assembly becomes fixed in place by the welding process. Therefore, it is not possible to alter the rotational position of the wellhead assembly without cutting the wellhead assembly from the landing mandrel Upon drilling an initial hole, the conductor pipe 20 is installed into the ground. In one embodiment, the conductor pipe 20 may have a diameter of thirty inches. Although not illustrated, in most instances, the initial hole is drilled starting at the bottom of a cellar or pit (not shown) excavated and reinforced from the surface level. After installation of the conductor pipe 20, the conductor pipe 20 is measured and cut for installation of a support ring 24. Following the sizing of the conductor pipe 20 and the attachment of the support ring 24, a diverter system (not shown) is installed to control flow to the mud pit or mud holding tank while drilling out and cementing the surface casing string 22. The surface casing string 22 in this example is twenty inches in diameter.

A landing ring 26 is attached to a terminal end 23 of the surface casing string 22 by way of a suitable connection, such as threaded or welded. In the illustrated embodiment, the landing ring 26 has a flange 28 which is fluted to define a plurality of flange portions 30. Each flange portion 30 has a lower beveled surface 32 designed to mate with the support ring 24 of the conductor pipe 20 when the surface casing string 22 is inserted into the conductor pipe 20. A landing joint (not shown) is threaded into the top portion of the landing ring 26 to accomplish the pumping of concrete into the surface casing string 22 and eventually up between the outer circumferential wall of the surface casing string 22 and the inner circumferential wall of the conductor pipe 20.

In the embodiment illustrated in FIGS. 1 and 2, the process for installing the surface casing string 22 is repeated for the casing string 14 except a landing mandrel 40 is connected to a terminal end 15 of the casing string 14. In this example, the casing string 14 may have a diameter of 13⅜ inches.

Referring now to FIGS. 3A-3D, wherein the landing mandrel 40 is illustrated. The landing mandrel 40 is a tubular member with an upper end 42, a lower end 44, an exterior surface 46, an interior surface 48 defining a first bore 49 with a counterbore **49*a* extending a predetermined distance from the lower end 44 and configured to matingly recieve an end of the casing string 14, and a flange portion 50 extending outwardly from the exterior surface 46. The the counterbore 49*a* may be threaded for threaded connection to the terminal end of the casing string 14. The interior surface 48 at the upper end 42** may also be threaded for threadingly receiving a landing joint (not shown) in a manner well known in the art.

The flange portion 50 is positioned between the upper end 42 and the lower end 44 so as to define a neck portion 52 between the flange portion 50 and the upper end 42. The flange portion 50 may be fluted so as to define a plurality of flange segments 54 spaced apart from one another to facilitate the cementing of the casing string 14 in a manner known in the art. In the illustrated embodiment, the landing mandrel 40 has four flange segments 54, but it will be appreciated that the number of flange segments 54 can be varied from two or more. Each of the flange segments 54 has an upper surface 56 and a lower surface 58. The upper surface 56 is planar and extends perpendicular to a longitudinal axis A of the landing mandrel 40. The lower surface 58 is beveled and designed to mate with an upper end of the landing ring 26 when the casing string 14 is inserted into the surface casing string 22. It will be appreciated that the lower beveled surface 58 will mate with the upper end of the support ring 24 in those instances when the surface casing string 22 is connected to the wellhead assembly 12.

Each of the flange segments 54 has an annular groove 60 formed in an outer peripheral surface 63 of the flange segments 54 defining an upper flange 61 between the groove 60 and the upper surface 56. It should be noted that when the flange portion 50 is fluted to form the flange segments 54, the annular groove 60 continues through each of the flange segments 54 to define an annular groove extending circumferentially about the flange portion 50. Each of the grooves 60 in each of the flange segments 54 has a lower face 62, an upper face 64, and an intermediate face 66. The lower face 62 is perpendicular to the longitudinal axis A of the landing mandrel 40, and the intermediate face 66 is perpendicular to the lower face 62. The upper face 64 is angled relative to the lower face 62. The angle of the upper face 64 relative to the lower face 62 may be varied, but in one embodiment, the angle is in a range of from an absolute angle of substantially 15° to an absolute angle of substantially 35°.

At this point, the wellhead assembly 12 is prepared for attachment onto the casing string 14 (or the surface casing string 22). It should be appreciated that, although several different wellhead components can be included to form a wellhead assembly, only those that directly interact with the connection between the casing string 14 and the wellhead assembly 12 are discussed herein. Depending upon the type of drilling operation, some or all of the components of the wellhead assembly 12 can be pre-assembled before attachment to the casing string 14.

Figure 4A:
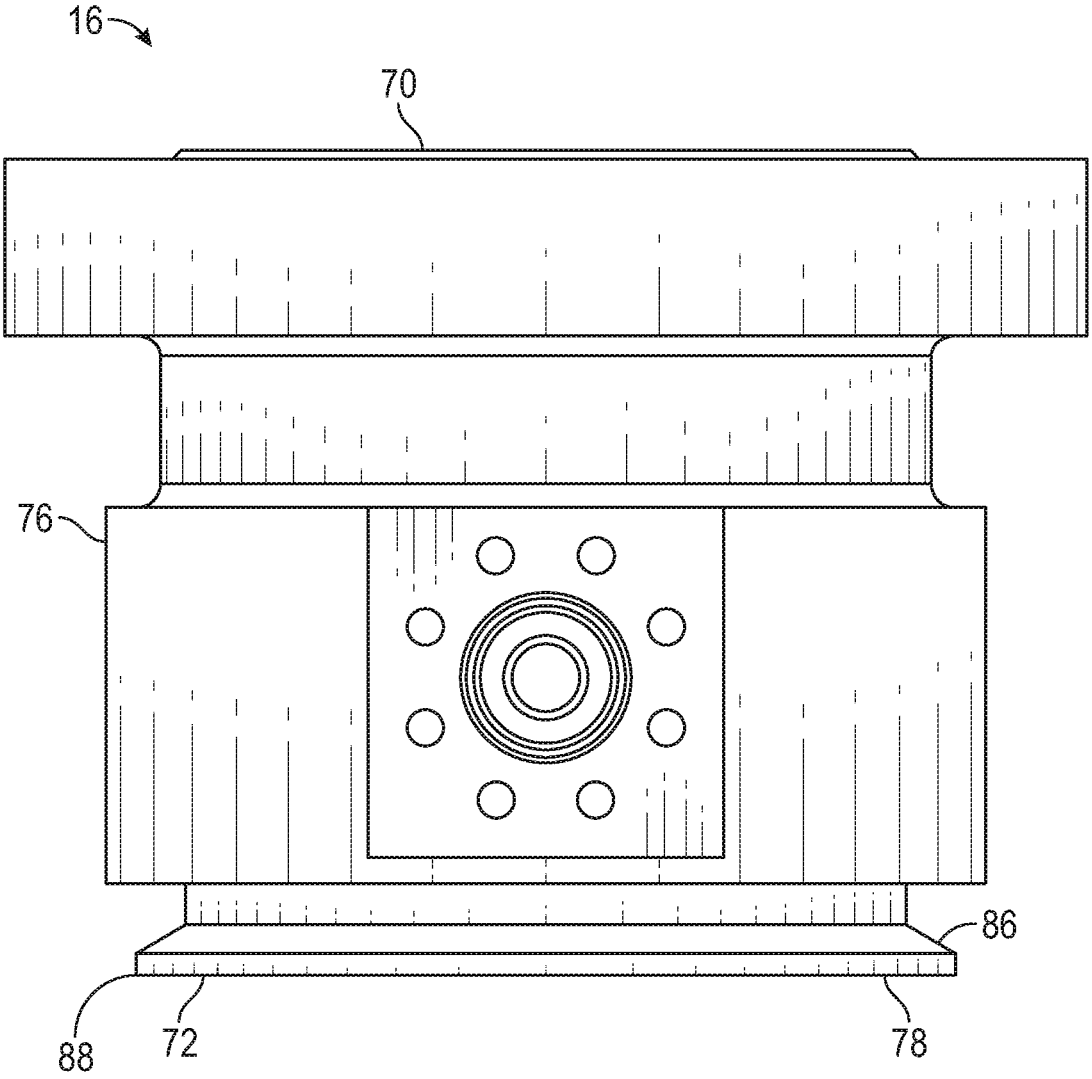
FIG. 4A is a side elevational view of a casing head constructed in accordance with the inventive concepts disclosed herein.
Figure 4B:
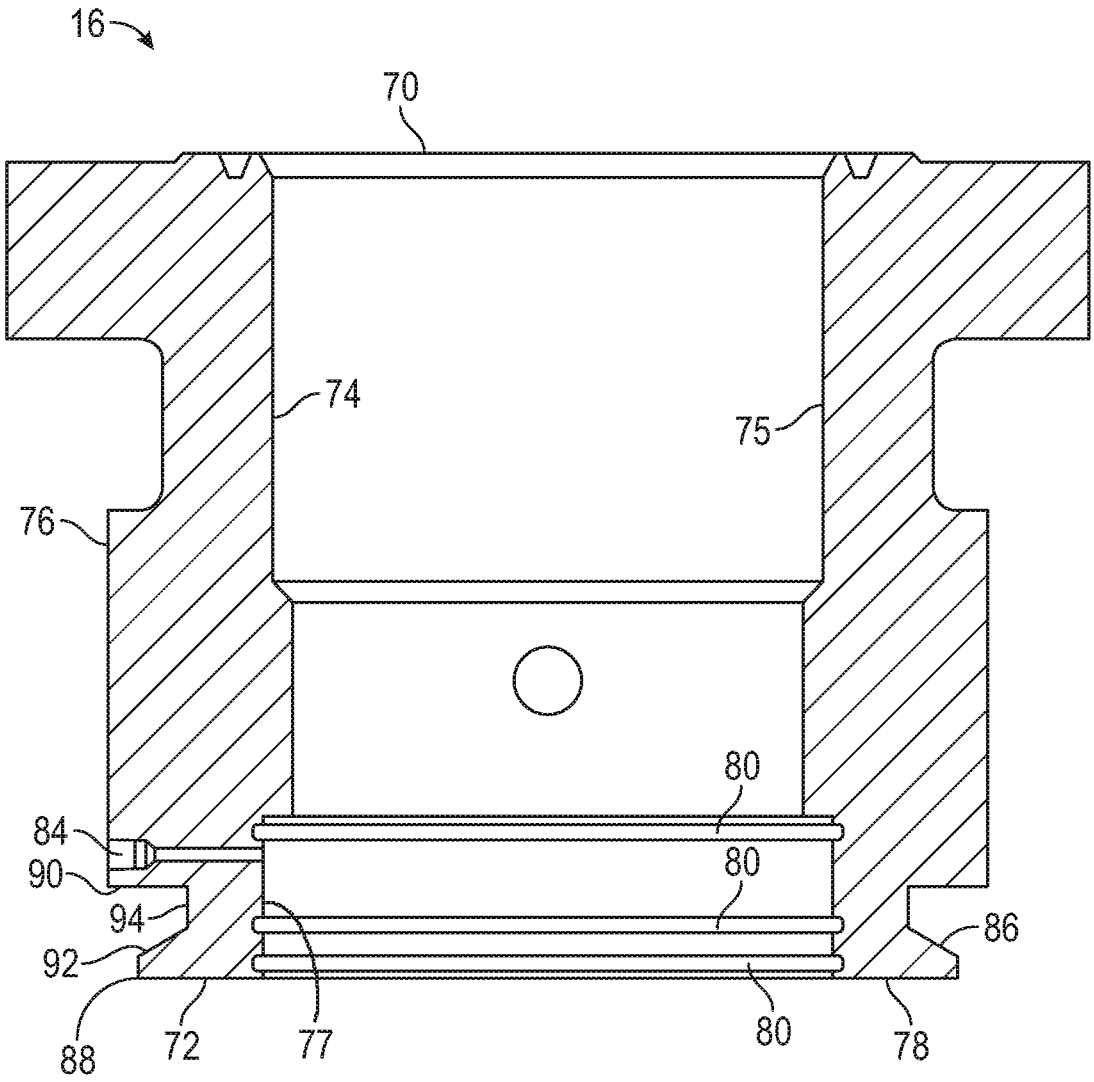
FIG. 4B is a sectional view of the casing head of FIG. 4A.

Referring now to FIGS. 4A and 4B, one embodiment of the casing head 16 is illustrated. The casing head 16 has an upper end 70, a lower end 72, an internal surface 74 defining a second bore 75, and an external surface 76. The lower end 72 has a planar face 78. The internal surface 74 at the lower end 72 may be provided with a counterbore 77 (FIG. 4B) to matingly receive the neck portion 52 of the landing mandrel 40 with the planar face 78 of the casing head 16 in face to face contact with the upper surface 56 of the flange portion 50 of the landing mandrel 40. The internal surface 74 at the lower end 72 is provided with a plurality of annular grooves 80 for receiving seals 82 (FIGS. 1 and 5), and in turn for forming a sealed connection with the landing mandrel 40. The casing head 16 also includes a port 84 for injecting a sealant into the space between adjacent seals 82.

The casing head 16 further includes an annular groove 86 formed in the external surface 76 at the lower end 72 of the casing head 16. The annular groove 86 is configured to be a mirror image of the annular groove 60 formed in the landing mandrel 40. To this end, the annular groove 86 forms a lower flange 88 between the annular groove 86 and the planar face 78, and the annular groove 86 is defined by an upper face 90, a lower face 92, and an intermediate face 94. The upper face 90 is perpendicular to the longitudinal axis of the casing head 16, and the intermediate face 94 is perpendicular to the upper face 90. The lower face 92 is angled relative to the upper face 90. The angle of the lower face 92 relative to the upper face 90 may be varied, but in one embodiment, the angle is in a range of from an absolute angle of substantially 15° to an absolute angle of substantially 35°.

The casing head 16 also includes several additional features that will be understood by those of ordinary skill in the art, but deemed not necessary to discuss in detail herein.

Figure 5:
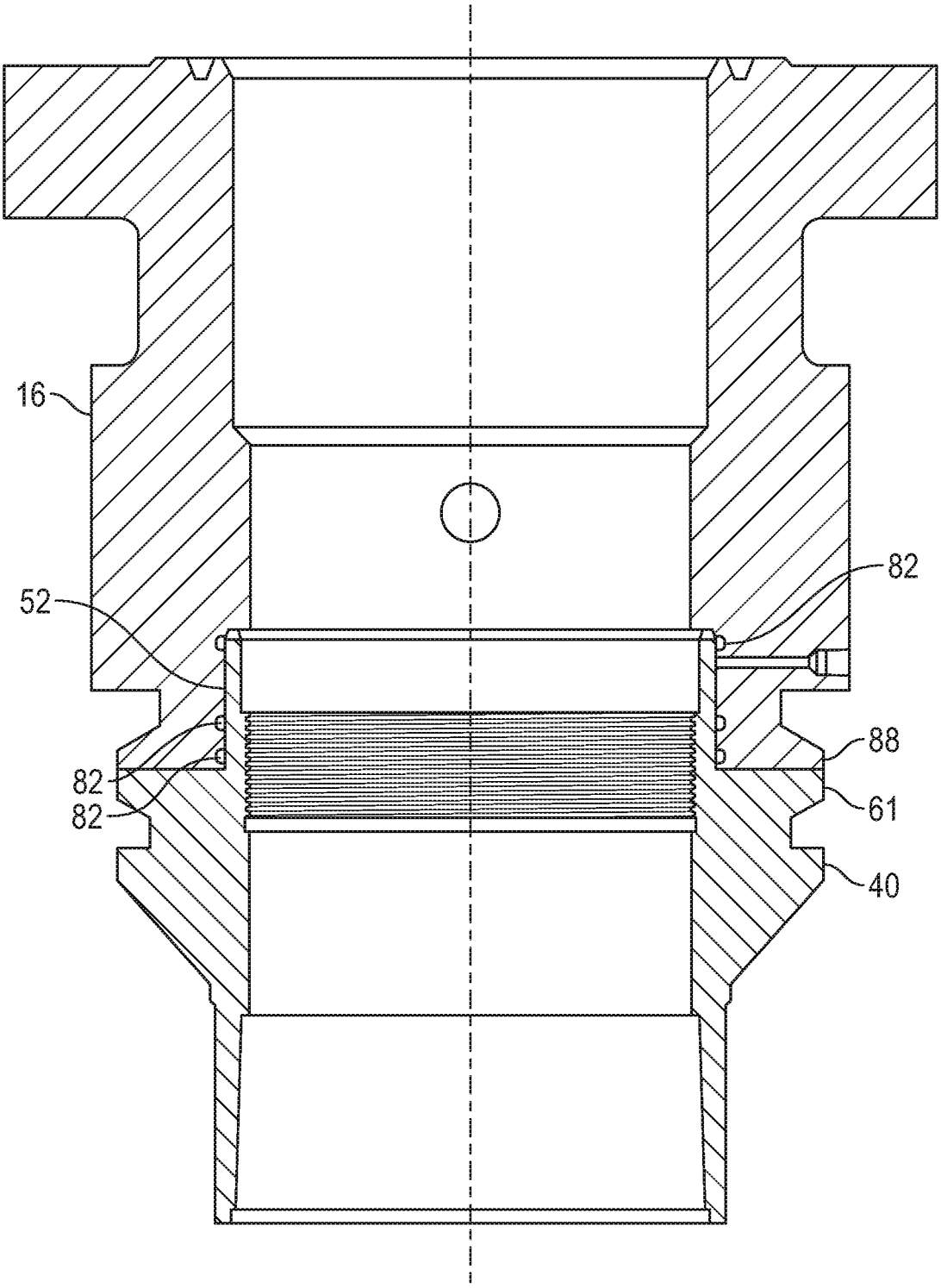
FIG. 5 is a sectional view of an assembly of the landing mandrel and the casing head.

FIG. 5 shows the casing head 16 mated with the landing mandrel 40. When mated, the counterbore 77 of the casing head 16 is slidingly received over the neck portion 52 of the landing mandrel 40 so that the seals 82 sealingly contact the exterior surface of the neck portion 52.

Figure 6A:
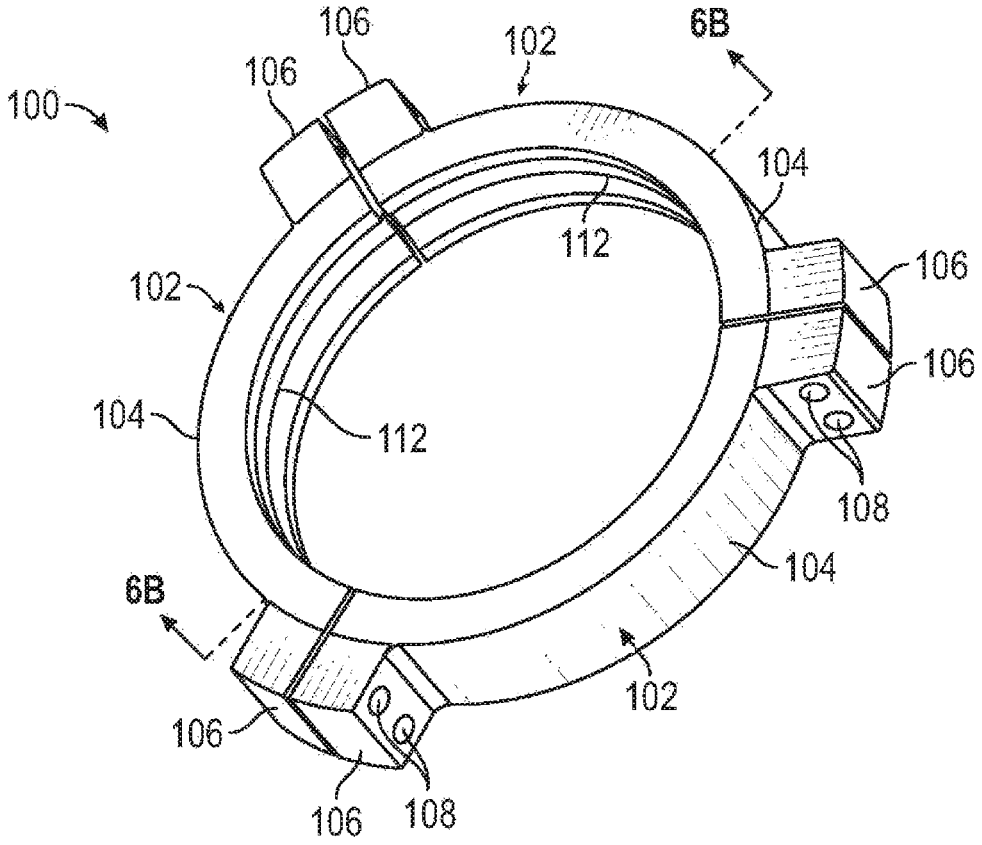
FIG. 6A is a perspective view of a clamp ring constructed in accordance with the inventive concepts disclosed herein.
Figure 6B:
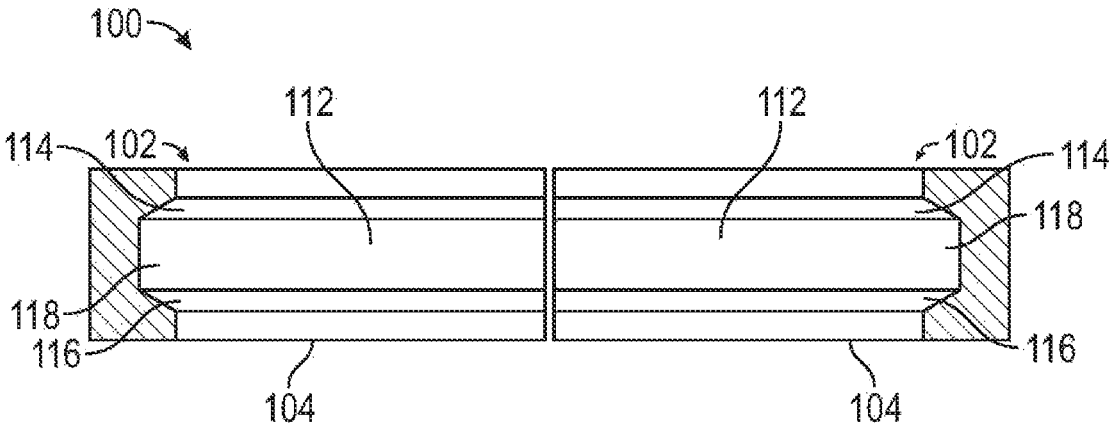
FIG. 6B is a sectional view of a segment of the clamp ring taken along line 6B-6B of FIG. 6A.

With the casing head 16 lowered onto the landing mandrel 40, the clamp ring 100 (FIGS. 1, 2, 6A, and 6B) is installed about the lower flange 88 of the casing head 16 and the upper flange 61 of the landing mandrel 40. As shown in FIGS. 6A and 6B, the clamp ring 100 has a plurality of ring segments 102. In the illustrated embodiment, the clamp ring 100 includes three ring segments 102. It should be appreciated, however, that in various embodiments, the number of ring segments can vary from two or more.

Each ring segment 102 has an arcuate body 104 and a pair of lugs 106 extending radially outwardly from the ends of the body 104. The lugs 106 are provided with holes 108 through which bolts 110 (FIG. 1), or other securing means known in the art can be used to operate the ring segments between a non-tightened condition and a tightened condition.

The interior side of each of the bodies 104 has a groove 112 defined by an upper face 114, a lower face 116, and an intermediate face 118. The upper face 114 and the lower face 116 are angled to complement the angle of the lower face 92 of the casing head 16 and the upper face 64 of the landing mandrel 40 in a way that a wedging action is created between the ring segments 102 and the lower flange 88 of the casing head 16 and the upper flange 61 of the landing mandrel 40 when the ring segments 102 are drawn to the tightened condition.

With the clamp ring 100 positioned about the upper flange 61 and the lower flange 88, but in the non-tightened condition, the wellhead assembly 12 is connected to the landing mandrel 40. However, the wellhead assembly 12 may be rotated relative to the landing mandrel 40, if desired, to alter the rotational position of the wellhead assembly 12. Once the desired position of the wellhead assembly 12 is achieved, the clamp ring 100 may be tightened thereby fixing casing head 16 to the landing mandrel 40.

In addition to enabling a quick and reliable sealed connection between the wellhead assembly 12 and the casing string 14, the present disclosure allows for quick and easy disconnection of the same. Rather than requiring a torch cutter, saw, or other means of removing a welded joint, one must only remove the clamp ring 100 and hoist the wellhead assembly 12. It should be appreciated that such ease of maneuverability is desirable to ensure that valves and pipes of the wellhead assembly 12 can be rearranged efficiently as circumstances require by rotating the wellhead assembly 12.

From the above description, it is clear that the inventive concepts disclosed and claimed herein are well adapted to carry out the objects and to attain the advantages mentioned herein, as well as those inherent in the invention. While exemplary embodiments of the inventive concepts have been described for purposes of this disclosure, it will be understood that numerous changes may be made which will readily suggest themselves to those skilled in the art and which are accomplished within the spirit of the inventive concepts disclosed and claimed herein.

What is claimed is:

1. A wellhead connection assembly, comprising:

a landing mandrel having an upper end, a lower end connectable to an upper end of a casing string, an external surface, an internal surface forming a first bore extending from the lower end to the upper end, a flange portion positioned a distance from the upper end so as to define a neck portion extending between the flange portion and the upper end, the flange portion provided with a planar upper surface extending perpendicular to a longitudinal axis of the landing mandrel, a beveled lower surface, and an annular groove extending circumferentially about the flange portion between the upper surface and the lower surface, the annular groove having a lower face perpendicular to the longitudinal axis of the landing mandrel, an intermediate face perpendicular to the lower face, and an upper face angled relative to the lower face, the upper face and the planar upper surface forming an upper flange;

a casing head having an upper end, a lower end, an external surface, an internal surface forming a second bore extending from the lower end to the upper end, the second bore having a counterbore formed at the lower end matingly received over the neck of the landing mandrel, and an annular groove formed in and extending circumferentially about the external surface at the lower end of the casing head, the annular groove having an upper face perpendicular to the longitudinal axis of the casing head, an intermediate face perpendicular to the upper face, and a lower face angled relative to the upper face, the lower face and the lower end of the casing head forming a lower flange; and a clamp ring formed of at least two ring segments, each of the at least two ring segments having a first end, a second end, an external side, and an internal side, the internal side having a groove defined by an upper face, a lower face, and an intermediate face, the upper face and the lower face of each of the ring segments being angled to complement the angle of the lower face of the casing head and the upper face of the landing mandrel, wherein each of the ring segments is positioned about the upper flange of the casing head and the lower flange of the casing head with the upper flange and the lower flange received in the groove of the ring segments, and wherein the first end of one of the ring segments is connected to the second end of another one of the ring segments in a way that the clamp ring is operable between a non-tightened condition wherein the casing head is rotatable relative to the landing mandrel and a tightened condition wherein a wedging action is created between the clamp ring and the upper flange of the landing mandrel and the lower flange of the casing head to fix the casing head to the landing mandrel.

2. The wellhead connection assembly of claim 1, wherein the first end of each of the ring segments has a first connecting lug, and the second end of each of the ring segments has a second connecting lug.

3. The wellhead connection assembly of claim 1, wherein the flange portion of the casing landing is fluted so as to define a plurality of flange segments spaced apart from one another.

4. The wellhead connection assembly of claim 1, wherein the neck of the landing mandrel includes a plurality of seals and wherein the casing head has a port extending from the external surface to the internal surface and positioned between adjacent seals of the landing mandrel.

5. The wellhead connection assembly of claim 1, wherein the first bore of the landing mandrel further includes a counterbore extending a predetermined distance from the lower end and configured to matingly receive an end of a casing string.

6. A wellhead connection assembly, comprising:

a landing mandrel having an upper end, a lower end connectable to an upper end of a casing string, an external surface, an internal surface forming a first bore extending from the lower end to the upper end, a flange portion positioned a distance from the upper end so as to define a neck portion extending between the flange portion and the upper end, the flange portion provided with a planar upper surface extending perpendicular to a longitudinal axis of the landing mandrel, a beveled lower surface, and an annular groove extending circumferentially about the flange portion between the upper surface and the lower surface, the annular groove having a lower face perpendicular to the longitudinal axis of the landing mandrel, an intermediate face perpendicular to the lower face, and an upper face angled relative to the lower face, the upper face and the planar upper surface forming an upper flange;

a casing head having an upper end, a lower end, an external surface, an internal surface forming a second bore extending from the lower end to the upper end, the second bore having a counterbore formed at the lower end matingly receivable over the neck of the landing mandrel, and an annular groove formed in and extending circumferentially about the external surface at the lower end of the casing head, the annular groove having an upper face perpendicular to the longitudinal axis of the casing head, an intermediate face perpendicular to the upper face, and a lower face angled relative to the upper face, the lower face and the lower end of the casing head forming a lower flange; and a clamp ring formed of at least two ring segments, each of the at least two ring segments having a first end, a second end, an external side, and an internal side, the internal side having a groove defined by an upper face, a lower face, and an intermediate face, the upper face and the lower face of each of the ring segments being angled to complement the angle of the lower face of the casing head and the upper face of the landing mandrel, wherein each of the ring segments is positionable about the upper flange of the casing head and the lower flange of the casing head with the upper flange and the lower flange received in the groove of the ring segments, and wherein the first end of one of the ring segments is connectable to the second end of another one of the ring segments in a way that the clamp ring is operable between a non-tightened condition wherein the casing head is rotatable relative to the landing mandrel and a tightened condition wherein a wedging action is created between the clamp ring and the upper flange of the landing mandrel and the lower flange of the casing head to fix the casing head to the landing mandrel.

7. The wellhead connection assembly of claim 6, wherein the first end of each of the ring segments has a first connecting lug, and the second end of each of the ring segments has a second connecting lug.

8. The wellhead connection assembly of claim 6, wherein the flange portion of the casing landing is fluted so as to define a plurality of flange segments spaced apart from one another.

9. The wellhead connection assembly of claim 6, wherein the neck of the landing mandrel includes a plurality of seals and wherein the casing head has a port extending from the external surface to the internal surface and positioned between adjacent seals of the landing mandrel when the casing head is received over the landing mandrel.

10. The wellhead connection assembly of claim 6, wherein the first bore of the landing mandrel further includes a counterbore extending a predetermined distance from the lower end and configured to matingly received an end of a casing string.

11. A method of connecting a casing head to a casing landing: comprising:

obtaining a landing mandrel comprising an upper end, a lower end connectable to an upper end of a casing string, an external surface, an internal surface forming a first bore extending from the lower end to the upper end, a flange portion positioned a distance from the upper end so as to define a neck portion extending between the flange portion and the upper end, the flange portion provided with a planar upper surface extending perpendicular to a longitudinal axis of the landing mandrel, a beveled lower surface, and an annular groove extending circumferentially about the flange portion between the upper surface and the lower surface, the annular groove having a lower face perpendicular to the longitudinal axis of the landing mandrel, an intermediate face perpendicular to the lower face, and an upper face angled relative to the lower face, the upper face and the planar upper surface forming an upper flange; and obtaining a casing head having an upper end, a lower end, an external surface, an internal surface forming a second bore extending from the lower end to the upper end, the second bore having a counterbore formed at the lower end matingly receivable over the neck of the landing mandrel, and an annular groove formed in and extending circumferentially about the external surface at the lower end of the casing head, the annular groove having an upper face perpendicular to the longitudinal axis of the casing head, an intermediate face perpendicular to the upper face, and a lower face angled relative to the upper face, the lower face and the lower end of the casing head forming a lower flange, the method comprising:

positioning the casing head on the landing mandrel with the counterbore of the casing head received over the neck of the landing mandrel;

positioning a clamp ring formed of at least two ring segments about the upper flange of the casing head and the lower flange of the casing head, each of the at least two ring segments having a first end, a second end, an external side, and an internal side, the internal side having a groove defined by an upper face, a lower face, and an intermediate face, the upper face and the lower face of each of the ring segments being angled to complement the angle of the lower face of the casing head and the upper face of the landing mandrel, wherein each of the ring segments is positioned about the upper flange of the casing head and the lower flange of the casing head with the upper flange and the lower flange received in the groove of the ring segments, and placing the clamp ring in a non-tightened condition;

rotating the casing head relative to the casing landing to a desired position; and tightening the clamp ring to create a wedging action between the clamp ring and the upper flange of the landing mandrel and the lower flange of the casing head thereby fixing the casing head to the landing mandrel in the desired position.

12. The method of claim 11, further comprising the steps of:

placing the clamp ring in the non-tightened condition;

rotating the casing head relative to the casing landing to another desired position; and tightening the clamp ring to create a wedging action between the clamp ring and the upper flange of the landing mandrel and the lower flange of the casing head thereby fixing the casing head to the landing mandrel in the other desired position.

* * * * *